United States Patent [19]

Negron

[11] Patent Number: 5,020,801

[45] Date of Patent: Jun. 4, 1991

[54] BASEBALL HOME RUN CONTEST GAME

[76] Inventor: William Negron, 70 E. 162nd St., Apt. 6-H, Bronx, N.Y. 10452

[21] Appl. No.: 512,397

[22] Filed: Apr. 23, 1990

[51] Int. Cl.[5] ..... A63F 7/06

[52] U.S. Cl. ..... 273/89; 273/129 S; 273/129 V; 273/85 A

[58] Field of Search ..... 273/88-90, 273/85 R, 85 A, 85 E, 1 E, 1 GC, 118 A, 119 A, 126 A, 129 S, 129 V

[56] References Cited

U.S. PATENT DOCUMENTS

| | | | |
|---|---|---|---|
| 861,843 | 7/1907 | Heitmann | 273/129 V |
| 1,008,898 | 11/1911 | Fuzton et al. | 273/89 |
| 1,144,472 | 6/1915 | Harbearson | 273/90 |
| 1,168,829 | 1/1916 | Sheppard | 273/89 |
| 1,170,467 | 2/1916 | Taylor | 273/88 |
| 1,320,606 | 11/1919 | De Haven | 273/90 |
| 1,396,798 | 11/1921 | Weinberg et al. | 273/89 |
| 1,617,546 | 2/1927 | Schmid | 273/89 |
| 1,626,778 | 5/1927 | Barker | 273/89 |
| 1,808,802 | 6/1931 | Weinberg | 273/89 |
| 1,896,684 | 2/1933 | Cutting et al. | 273/89 |
| 1,955,104 | 4/1934 | Spier | 273/88 |
| 2,325,858 | 8/1943 | Kellermann et al. | 273/89 |
| 2,466,156 | 4/1949 | Dawson et al. | 273/88 |
| 2,494,248 | 1/1950 | Koppin | 273/89 |
| 2,534,468 | 12/1950 | Mitchell | 273/89 |
| 3,133,733 | 5/1964 | Elseroad | 273/88 |
| 3,355,173 | 11/1967 | Selker | 273/89 |
| 4,519,610 | 5/1985 | Kallio | 273/89 |

*Primary Examiner*—William H. Grieb
*Assistant Examiner*—Sebastiano Passaniti
*Attorney, Agent, or Firm*—Richard L. Miller

[57] ABSTRACT

A baseball home run contest game is provided and consists of a pitching mechanism mounted to one end of an elongated platform, while a batting mechanism is mounted to other opposite end of the platform. The pitching mechanism is electrically operated at various speeds by a first player to propel a miniature baseball therefrom. The batting mechanism is electrically operated at various speeds by a second player to hit the baseball towards a miniature wall structure positioned remotely behind the pitching mechanism. The object of the game is to determine how many pitched baseballs can be hit over the miniature wall structure for home runs, out of ten pitched baseballs.

5 Claims, 1 Drawing Sheet

BASEBALL HOME RUN CONTEST GAME

BACKGROUND OF THE INVENTION

The instant invention relates generally to toy baseball games and more specifically it relates to a baseball home run contest game.

Numerous toy baseball games have been provided in the prior art that are adapted to include a baseball pitching mechanism for propelling a ball and a baseball batter mechanism for hitting the propelled ball. For example, U.S. Pat. Nos. 3,525,525 to Rideout; 4,078,800 to Goldfarb et al; and 4,179,123 to Tsukuda all are illustrative of such prior art. While these units may be suitable for the particular purpose to which they address, they would not be as suitable for the purpose of the present invention as hereafter described.

SUMMARY OF THE INVENTION

A primary object of the present invention is to provide a baseball home run contest game that will overcome the shortcomings of the prior art devices.

Another object is to provide a baseball home run contest game to determine how many pitched baseballs each player can hit over a miniature wall, for a home runs, out of ten pitched baseballs.

An additional object is to provide a baseball home run contest game in which a first player can operate a baseball pitching mechanism at various speeds while a second player can operate a base ball batter mechanism, which is a simulated miniature baseball player at bat, at various speeds.

A further object is to provide a baseball home run contest game that is simple and easy to use.

A still further object is to provide a baseball home run contest game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figures 1, 2, 3, 4:
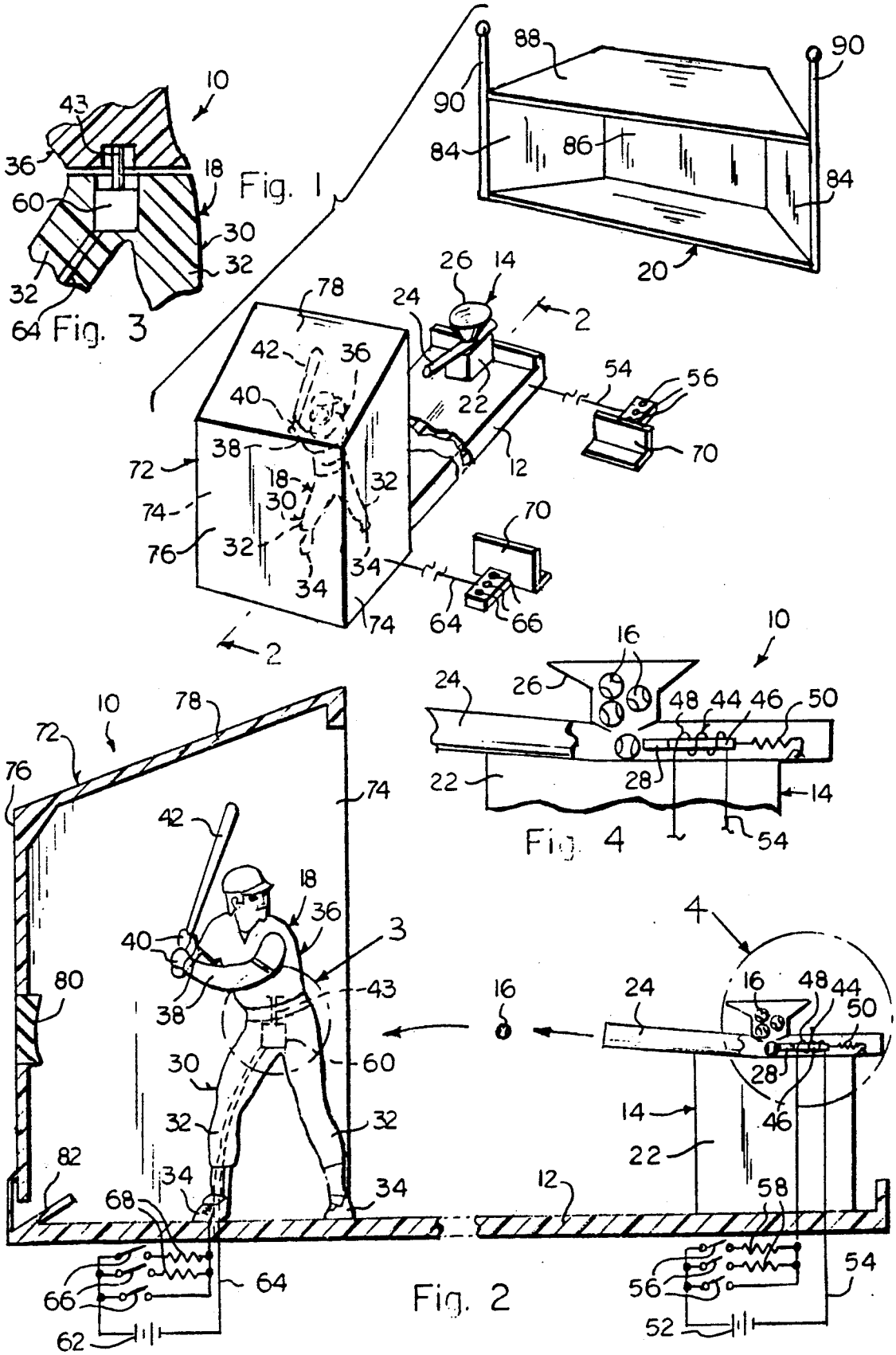
FIG. 1 is a perspective view of the instant invention.
FIG. 2 is an enlarged diagrammatic cross sectional view taken along line 2—2 in FIG. 1 showing the wiring circuits in the game.
FIG. 3 is an enlarged cross sectional view of a portion of the invention indicated by the arrow 3 in FIG. 2.
FIG. 4 is an enlarged cross sectional view of a portion of the invention indicated by the arrow 4 in FIG. 2.

Turning now descriptively to the drawings, in which like reference characters denote like elements throughout the several views, FIGS. 1 through 4 illustrates a baseball, home run contest game 10 consisting of an elongated platform 12 with a pitching mechanism 14 mounted to one end thereof. The pitching mechanism 14 is electrically operated at various speeds by a first player to propel a miniature baseball 16 therefrom. A batting mechanism 18 is mounted to other opposite end of the platform 12. The batting mechanism 18 is also electrically operated at various speeds by a second player to hit the miniature baseball 16 propelled thereto. A miniature wall structure 20 is positioned remotely behind the pitching mechanism 14. The object of the game 10 is to determine how many pitched baseballs 16 from the pitching mechanism 14 each player can hit from the batting mechanism 18 over the miniature wall structure 20, for home runs, out of ten pitched baseballs 16.

The pitching mechanism 14 includes a support member 22 affixed to the platform 12. A barrel 24 is affixed to top of the support member 22 with its distal end slanted upwardly therefrom. A hopper 26 is connected to top of the barrel 24 to allow one miniature baseball 16 to fall therefrom into the barrel 24. A plunger 28 is carried within the barrel 24 to make contact with the miniature baseball 16. The plunger 28 is electrically operated so as to propel the miniature baseball 16 out of the barrel 24 towards the batting mechanism 18.

The batter mechanism 18 is a simulated baseball batter which includes an upstanding lower body section 30 having legs 32 with feet 34 affixed to the platform 12. An upstanding upper torso 36 has arms 38 with hands 40 holding a baseball bat 42. An upright shaft 43 extends between the lower body section 30 and the upper torso section 36 so that the upper torso section can rotate with respect to the lower body section 30 about a generally upright axis. The shaft 43 is electrically operated so that the baseball bat 42 on the upper torso section 36 can try to hit the propelled baseball 16.

A solenoid 44 has an iron core rod 46 connected at one end of the plunger 28 and a coil 48 for operating the rod 46. A spring 50 is connected between other end of the rod 46 and the back of the barrel 24 to help return the rod 46 back to its original position after it is activated. A battery 52 is connected in circuit 54 to the coil 48 of the solenoid 44 to operate the rod 46. Typically three switches 56 are illustrated connected in parallel relationship with the circuit 54, although any convenient number might be chosen. Different value resistors 58 are each connected between one switch 56 and the coil 48 so that the switches 56 can operate the solenoid 44 at the various speeds.

A rotary solenoid 60 is in the lower body section 30 for operating the shaft 43. A battery 62 is connected in circuit 64 to the rotary solenoid 60 to operate the rotary solenoid. Typically three switches 66 are illustrated connected in a parallel relationship within the circuit 64. Different value resistors 68 are each connected between one switch 66 and the rotary solenoid 60 so that the switches 68 can operate the rotary solenoid at various speeds.

A batters cage 72 is mounted to the platform 12 over the batting mechanism 18. The batters cage 72 has a pair of side walls 74, a rear wall 76 and a rearwardly sloping top wall 78. An absorbent pad 80 is mounted within the rear wall 76 directly behind the batting mechanism 18 to cause a missed baseball 16 to drop directly downward. A catch bin 82 is formed between bottom of the rear wall 76 of the batters cage 72 and the platform 12 to receive the baseball 16 that drops directly downward thereto.

The miniature wall structure 20 includes a pair of inwardly extending side walls 84, a rear wall 86, a forwardly sloping top wall 88 and a pair of foul poles 90, each affixed along a front edge of each of the side walls 84.

To play the game 10, the first player operates the switches 56 to operate the pitching mechanism while the second player operates the switches 66 to operate the batting mechanism 18 to see how many home runs can be made out of the ten pitched baseballs 26. Two shield stands 70, are provided for blocking from view the first series of switches 56 and the second series of switches 66 so that one player cannot see how the other player is playing said game. The players then switch places and repeat the play of the game 10 as indicated above.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A baseball home run contest game comprising:

(a) an elongated platform;

(b) a pitching mechanism mounted to one end of said platform, said pitching mechanism electrically and selectively operable at various speeds by a first player to propel a miniature baseball therefrom, wherein said pitching mechanism includes:

(i) a support member affixed to said platform;

(ii) a barrel affixed to a top of said support member with a distal end of the barrel being slanted upwardly therefrom;

(iii) a hopper connected to a top of said barrel to allow one miniature baseball at a time to fall therefrom into said barrel;

(iv) a plunger carried within said barrel to make contact with the one miniature baseball; and (v) means for electrically operating said plunger so as to propel the miniature baseball out of said barrel towards a batting mechanism;

(c) said batting mechanism mounted to an opposite end of said platform, said batting mechanism electrically and selectively operable at various speeds by a second player to hit the miniature baseball propelled thereto, wherein said batting mechanism is a simulated miniature baseball batter which includes:

(i) an upstanding lower body section having legs with feet affixed to said platform;

(ii) an upstanding upper torso section having arms with hands holding a simulated baseball bat;

(iii) an upright shaft extending between said lower body section and said upper torso section so that said upper torso section can rotate with respect to said lower body section about a generally upright axis; and (iv) means for electrically rotating said shaft so that the baseball bat on said upper torso section can hit the propelled baseball; and (d) a miniature wall structure positionable remotely behind said pitching mechanism, whereby balls not hit with sufficient force by said batting mechanism may be captured in said miniature wall structure, while balls hit with sufficient force may pass over said miniature wall structure; and (e) means for electrically operating said pitching mechanism by said first player including:

(i) a solenoid having an iron core rod connected at one end to said plunger and a coil for operating said rod;

(ii) a spring connected between another end of said rod and a back of said barrel to help return the rod back to its original position after it is activated;

(iii) a battery connected in circuit to the coil of said solenoid to operate the rod;

(iv) a first series of at least three switches connected in a parallel relationship with the circuit; and (v) at least two different resistors, each connected between one of said switches and the coil so that said switches can selectively operate said solenoid at the various speeds.

2. A baseball home run contest game as recited in claim 1, wherein said means for electrically rotating said shaft includes:

(a) a rotary solenoid in said lower body section for operating said shaft;

(b) a battery connected in circuit to said rotary solenoid to operate said rotary solenoid;

(c) at least three switches connected in a parallel relationship within the circuit; and (d) a second series of at least two different resistors, each connected between one of said switches and said rotary solenoid so that said switches can selectively operate said rotary solenoid at various speeds.

3. A baseball home run contest game as recited in claim 2, further including two shield stands, each provided for blocking from view said first series of switches and said second series of switches so that one player cannot see how the other player is playing said game.

4. A baseball home run contest game as recited in claim 3, further including:

(a) a batters cage mounted to said platform over said batting mechanism, said batters cage having a pair of side walls, a rear wall and a rearwardly sloping top wall;

(b) an absorbent pad mounted within the rear wall directly behind said batting mechanism to cause a missed baseball to drop directly downward; and (c) a catch bin formed between a bottom of the rear wall of said batters cage and said platform to receive the baseball that drops directly downward thereto.

5. A baseball home run contest game as recited in claim 4, wherein said miniature wall structure includes a pair of inwardly extending side walls, a rear wall, a forwardly sloping top wall and a pair of foul poles, each affixed along a front edge of each of the side walls.

* * * * *